United States Patent [19]

Kichibayashi et al.

[11] Patent Number: 4,982,137

[45] Date of Patent: Jan. 1, 1991

[54] APPARATUS FOR IGNITING A DISCHARGE LAMP INCLUDING CIRCUITRY FOR PREVENTING CATAPHORESIS PHENOMENON GENERATION

[75] Inventors: Masakatsu Kichibayashi, Sakaide; Kazuhiko Ito, Hirakata; Shigeru Horii, Takatsuki; Masakatsu Ozawa, Hirakata; Kouji Miyazaki, Yawata, all of Japan

[73] Assignee: Matsushita Electric Industrial Co., Ltd., Osaka, Japan

[21] Appl. No.: 288,133

[22] Filed: Dec. 22, 1988

[30] Foreign Application Priority Data

| | | | |
|---|---|---|---|
| Dec. 24, 1987 | [JP] | Japan | 62-328594 |
| Dec. 24, 1987 | [JP] | Japan | 62-328595 |
| Dec. 24, 1987 | [JP] | Japan | 62-328596 |
| Dec. 24, 1987 | [JP] | Japan | 62-328597 |

[51] Int. Cl.[5] ..... H05B 37/02

[52] U.S. Cl. ..... 315/107; 315/219; 315/DIG. 2

[58] Field of Search ..... 315/219, DIG. 2, 94, 315/107, 200 R

[56] References Cited

U.S. PATENT DOCUMENTS 4,238,708 12/1980 Kaneda ..... 315/DIG. 2 X
4,647,817 3/1987 Fähnrich et al. ..... 315/101 X

*Primary Examiner*—Robert J. Pascal
*Attorney, Agent, or Firm*—Wenderoth, Lind & Ponack

[57] ABSTRACT

An apparatus is provided for driving a discharge lamp, the discharge lamp having first and second electrodes, each of the first and second electrodes having first and second terminals. The apparatus includes a switching circuit coupled to the first terminals of the first and second electrodes of the discharge lamp for supplying a high frequency signal to the discharge lamp for igniting the discharge lamp. A starting circuit is provided connected to the second terminals of the first and second electrodes of the discharge lamp and including an inductor and capacitor connected in parallel across the discharge lamp. Alternately, a thermister is provided between parallel connected conductor and capacitor and one of the second terminals of the first electrode of the discharge lamp. Furthermore, circuitry is provided which is connected between the switching circuit and the thermister for deactivating the switching circuit when the thermister is heated to a specified temperature.

10 Claims, 6 Drawing Sheets

APPARATUS FOR IGNITING A DISCHARGE LAMP INCLUDING CIRCUITRY FOR PREVENTING CATAPHORESIS PHENOMENON GENERATION

BACKGROUND OF THE INVENTION

This invention relates to a discharge lamp operation apparatus for staring and operating discharge lamp at a high frequency.

Recently, in the discharge lamp operation apparatus, attempts have been made to operate the discharge lamp using a high frequency inverter which is a switching circuit composed of a semiconductor device, in order to increase efficiency and reduce size and decrease weight. More recently, in particular, a compact fluorescent lamp is developed, and a smaller size has been demanded of the discharge lamp operation apparatus using a high frequency inverter. First the conventional discharge lamp operation apparatus is explained below while referring to the drawings.

FIG. 1 is a circuit diagram of a conventional discharge lamp operation apparatus, in which numeral 1 denotes a power supply circuit, 2 is an inverter circuit, and element 3 is a discharge lamp load circuit. The power supply circuit 1 rectifies and smooths an alternating-current power supply source 4 in a rectifying circuit 5, and delivers a DC output. Describing a DC inverter circuit 2, the emitter of a transistor 6 is connected to the negative side of the rectifying circuit 5, and a capacitor 7 for resonance is connected between the collector and the positive side of the rectifying circuit 5. One of the terminals of discharge lamp load circuit 3 is connected to the collector of the transistor 6, and the other one is connected to the positive side of the rectifying circuit 5 by way of a choke coil 8. This choke coil 8 is provided with a feedback winding 9, and one of its terminals is connected to the negative side of the rectifying circuit 5 while the other one is connected to the base of the transistor 6 through a series circuit consisting of an inductor 10 which is the driving inductor and a capacitor 11 which is the driving capacitor. A starting resistance 12 is connected between the base and the positive side of the rectifying circuit 5, and in order to feed a base current to the transistor 6 after start-up, a diode 13 and a resistance 14 are connected in series from the emitter to the base. The discharge lamp load circuit 3 comprises a fluorescent lamp 15 series assembly of a diode 18 and constant voltage switching device 19 connected as starting circuit 17 in parallel with the lamp 15 so as to be in forward direction with respect to the direct-current power supply between the non-feeding side terminals of its filament electrodes **16*a* and 16*b*, and capacitor 20 connected in parallel with the lamp 15 for stabilizing the oscillation of the inverter circuit 2** during its operation.

The operation of the thus composed conventional discharge lamp operation apparatus is explained below.

When the AC power supply 4 supplies power, it is rectified and smoothed in the rectifying circuit 5, and the current passes through the resistance 12 to flow into the base of the transistor 6 to turn on the transistor 6. Into the collector of the transistor 6, an electric current flows from the positive side of the rectifying circuit 5 through the choke coil 8, filament electrode **16*a* of fluorescent lamp 15, diode 18 and constant voltage switching element 19 of the starting circuit 17, and filament electrode 16*b*. On the other hand, the feedback winding 9 is connected to the choke coil 8, and through the series assembly of the inductor 10 and capacitor 11, the current flowing in the choke coil 8 is positively fed back to the base of the transistor 6. The circuit composes a resonance, circuit together with the capacitor 7 and the inductance of the choke coil 8**, thereby starting oscillation.

As for the oscillation load current, since the series assembly of diode 18 and constant voltage switching element 19 are connected in parallel to the non-feeding side of the fluorescent lamp 15 in the forward direction, the filament electrodes **16*a*, 16*b* of the fluorescent lamp 15 begin to be preheated by the current flowing from the positive side of the rectifying circuit 5 to the collector when the transistor 6 is turned on. On the other hand, as for the resonance voltage generated when the transistor 6 is turned off, since the diode 18 connected to the non-feeding side of the fluorescent lamp 15 is in a reverse direction, the current cannot flow, and a high voltage is applied between the filaments 16*a*, 16*b* of the fluorescent lamp 15, and the fluorescent lamp 15 is discharged, and its discharge current flows into the positive side of the rectifying circuit 5 from the collector. Thereafter, repeating preheating and discharge alternately, the filament electrodes 16*a*, 16*b* of the fluorescent lamp 15 are preheated, and when preheated as specified, the fluorescent lamp 15 is ignited. When ignited, the voltage between the filament electrodes 16*a*, 16*b* becomes the lamp voltage for the fluorescent lamp 15. Since the breakover voltage of the constant voltage switching element 19 is set slightly higher than the lamp voltage of the fluorescent lamp 15, after the fluorescent lamp 15 is ignited, no current flows in the constant voltage switching element 19**.

In such composition, however, since the circuit is composed to operate the choke coil 8 as the resonant inductor of the inverter, while the fluorescent lamp 15 is ignited, the DC component flowing through the transistor 6 is superposed on the high frequency current, and the current as shown in FIG. 2 flows into the discharge path of the fluorescent lamp 15.

It does not matter that the current flowing in the discharge path of the fluorescent lamp 15 is a symmetric alternating current, but when it is ignited for a long period by passing an alternating current containing DC components as in the above composition when the ambient temperature is low, the mercury vapor is concentrated on one electrode, and emission ununiformity occurs in the fluorescent lamp 15, so that the luminous flux is lowered. This is the so-called cataphoresis phenomenon.

Furthermore, when starting up the fluorescent lamp 10, the energy for starting up is insufficient, and if the series resonance of the capacitor 20 and choke coil 8 is utilized in order to improve it, the impedance of the fluorescent lamp 10 varies largely, suddenly and irregularly in the abnormal state upon starting up or in the terminal phase of the service life. As a result, not only the resonance occurring between the series resonance circuit of capacitor 20 and choke coil 8 and the capacitor 7 increases, but also the inductance value between the driving capacitor 11 and inductance 10 varies, and the storage time of the transistor 11 varies, thereby inducing periodic deviation and abnormal oscillation, and finally breakdown of the circuit.

Moreover, a large voltage is suddenly applied on the fluorescent lamp 15, which can shorten the life service of the fluorescent lamp 15.

SUMMARY OF THE INVENTION

It is hence a primary object of this invention to present a discharge lamp operation apparatus capable of solving the above-discussed problems in the prior art.

A embodiment include a power supply having a constant polarity output voltage, a discharge lamp having at least two mutually confronting electrodes, a switching circuit connected to the output end of the power supply, having at least one transistor, inductor and capacitor, and starting and igniting, at high frequency, the discharge lamp connected to the output end through the inductor by turning on and off the forward current using the transistor, and an inductor and a capacitor connected parallel to the discharge lamp.

Another embodiment includes a series circuit composed of at least the secondary winding of the a driving inductor of the switching circuit, inductor and driving capacitor for driving the transistor, and connected between the base and emitter of the transistor, a diode connected to the base of the transistor, a resistance connected between the diode and emitter, and a zener diode connected between the connecting point of the driving inductor and driving the capacitor and the connecting point between the resistance and diode so that the ends of the same polarity as the diode may be connected together. Alternately a transistor is provided for short-circuiting having the collector and emitter connected in parallel to the driving inductance, a zener diode connected between the collector and base of this transistor so that the base current may flow though the zener voltage, and a timer circuit having the output connected to the base so as to turn off the transistor after the specified time.

Another embodiment includes a parallel circuit of inductor and capacitor having a PTC thermistor connected parallel to the discharge lamp and at the anti-transistor side or a series circuit of at least capacitor and PTC thermistor, a voltage response switching device having one end connected to the connecting point between the PTC thermistor and capacitor A, and a three-terminal control device for stopping the current for driving the transistor from the driving circuit of the switching circuit by the control current flowing into the control device connected to the other end of the voltage response switching device.

In an embodiment having the composition described above, when starting, an oscillation current of the switching circuit flows through the inductor and capacitor connected in parallel to the discharge lamp, and a starting voltage and preheating current are supplied to the discharge lamp, and the DC component flowing in the discharge lamp load circuit when ignited escapes through the bypass of the inductor connected in parallel to the discharge lamp, so that only high frequency current components flow in the discharge lamp.

In one other embodiment, the surge voltage generated in the driving inductor when switching the transistor, is absorbed by the zener diode, and the driving capacitor is charged through the resistance and zener diode, while the reverse current when turning on the transistor is passed through the resistance and diode.

Alternately, the surge voltage generated in the driving inductor when switching the transistor or the abnormal voltage generated in the driving inductor when the resonant state is enlarged in the event of abnormality is absorbed by the zener diode and the transistor for short-circuiting, and the malfunction of the transistor for short-circuiting is prevented by the forward characteristic of the zener diode installed between the collector and base of the transistor for short-circuiting.

According, to the composition of another embodiment, in the so-called emitterless state having the emitter lost at one side or both sides of the electrodes at the end of the service life of the discharge lamp, the discharge lamp is hardly discharged, and the impedance is increased, and a large current flows through the PTC thermistor, and when the temperature of the PTC thermistor rises to exceed the curie temperature, the resistance suddenly increases. As a result, the potential at the connecting point of the PTC thermistor and capacitor is raised, and the three-element control device is actuated by the current flowing into the control device of the three-element control device through the voltage response switching device, so that the current to drive the transistor in the switching circuit is ceased, thereby stopping the oscillation operation of the switching circuit. When the electrode at the negative voltage side or at both sides of the power supply is emitterless, a larger current flows through the PTC thermistor, and the resistance of the PTC thermistor increases, and the current flowing directly through the lamp from the power supply is practically absent, and there is no current of transistor flowing through the inductor, so that the oscillation action of the switching circuit is stopped.

According to the present invention as described herein, the following benefits, among others, are obtained.

(1) According to an embodiment, by connecting the discharge lamp to the high frequency inverter by way of the choke coil and connecting the inductor and capacitor in parallel between both filament electrode terminals of the discharge lamp, even in a circuit which is designed to operate the choke coil for limiting and stabilizing the current of the discharge lamp as resonant inductor, since the DC component can be passed into the collector of the transistor through the inductor connected to the non-feed side of the discharge lamp and the filament of the discharge lamp, the inverter circuit can be oscillated. Moreover, since this DC component can be used in the preheating current of the discharge lamp filament, the preheating can be accelerated further. Furthermore, while ignited, the DC component contained in the discharge lamp current escapes through the bypass of the inductor connected between the both electrodes of the discharge lamp, so that only the high frequency current flows in the discharge lamp, and a discharge lamp operation apparatus free from cataphoresis phenomenon may be obtained. Incidentally, the voltage at both ends of the inductor is relatively high when starting, but the time of application is short, and after ignition, it drops to the lamp voltage of the discharge lamp, and therefore, the inductor requires a relatively small current capacity, and a small and inexpensive discharge lamp operation apparatus may be obtained.

(2) According to the another embodiment, the transistor can be operated securely by a simple and protected safely, so that the discharge lamp operation apparatus preventing malfunction and abnormal oscillation may be obtained.

(3) According to the another embodiment, in a simple and inexpensive circuit composition, when falling in an emitterless state at the end of the service life of the discharge lamp, the oscillation action of the switching circuit may be promptly stopped, and a discharge lamp operation apparatus capable of preventing breakdown of the transistor due to sudden temperature rise may be realized.

While the novel features of the invention are set forth in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 7 is a circuit diagram in a fourth embodiment of the invention; an

DETAILED DESCRIPTION OF THE INVENTION

Referring now to FIG. 3 through 8, preferred embodiments of the discharge lamp operation apparatus of the invention are described below.

Figure 1:
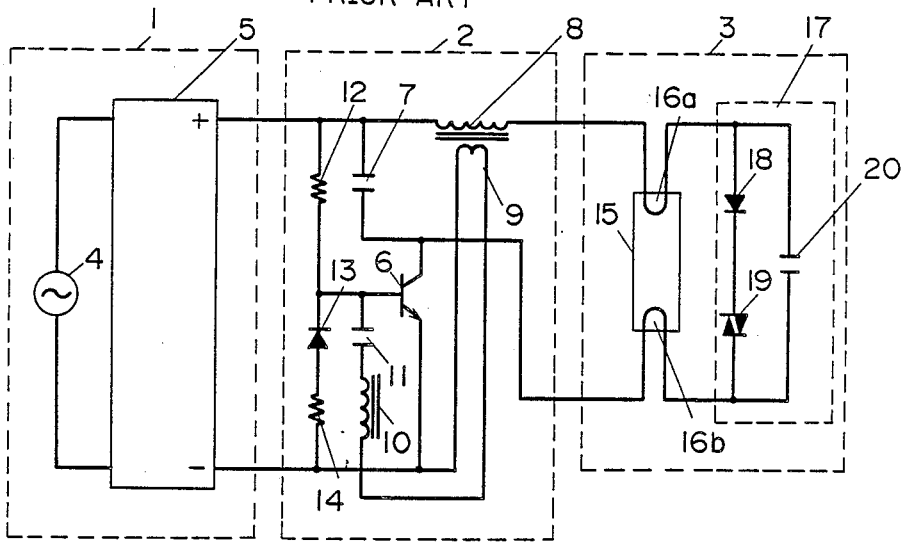
FIG. 1 PRIOR ART
FIG. 1 is a circuit diagram of a conventional discharge lamp operation apparatus.
Figure 2:
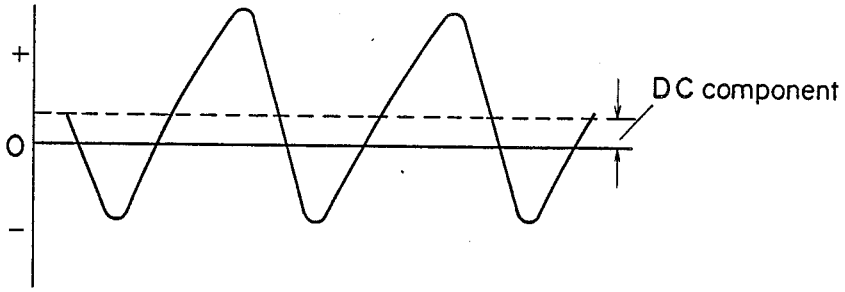
FIG. 2 PRIOR ART
FIG. 2 is a waveform diagram of current flowing in the discharge lamp when it is burned in the conventional discharge lamp operation apparatus.
Figure 3:
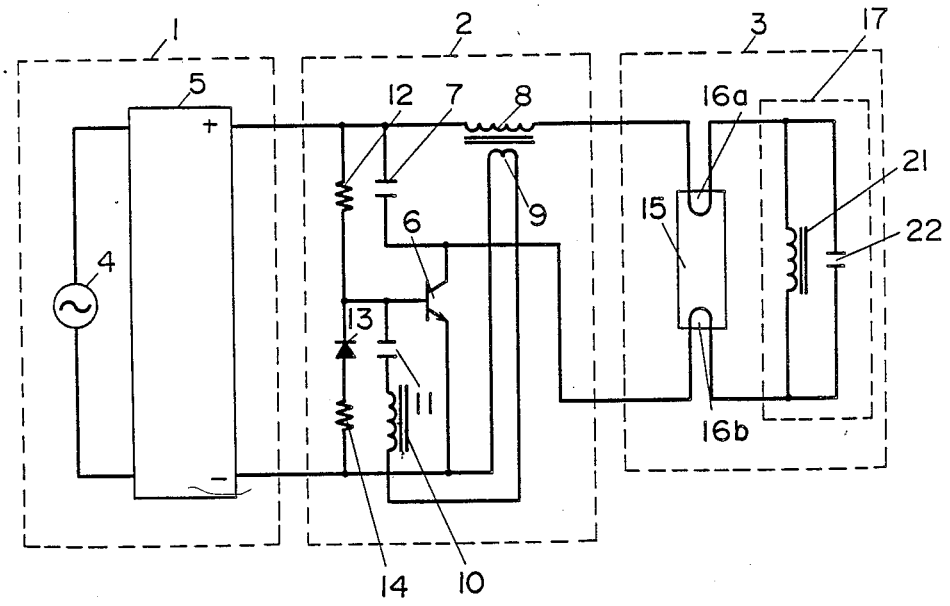
FIG. 3 is a circuit diagram in a first embodiment of the invention.

FIG. 3 is a circuit diagram of a discharge lamp operation apparatus according to a first embodiment of the invention. A power supply circuit 1 has an output voltage of constant polarity. An inverter circuit 2, which is a switching circuit, is connected to the output end of the power supply circuit 1 and includes at least one transistor, inductor and capacitor, for activating and operating, at high frequency, a fluorescent lamp 15. The fluorescent lamp 15 is a discharge lamp having at least two mutually confronting electrodes.

The difference between the prior art device and the device of FIG. 3 lies in the discharge lamp load circuit 3. In the discharge lamp load circuit of FIG. 3, an inductor 21 and a capacitor 22 are connected parallel, as a starting circuit, between the nonfeed side terminals of filament electrodes 16*a*, 16*b* of the fluorescent lamp 15.

The discharge lamp operation apparatus of FIG. 3 is described in detail below.

When the AC power 4 is applied, it is rectified and smoothed in a rectifying circuit 5, and the current passes through a resistance 12 into the base of the transistor 6, and the transistor 6 is switched ON. To the collector of the transistor 6, from the positive side of the rectifying circuit 5, a current is applied via a choke coil 8, the filament electrode 16*a* of the fluorescent lamp 15, and the parallel circuit of the inductor 21 and capacitor 22 of the starting circuit 17. On the other hand, a feedback winding 9 is connected to the choke coil 8, and through the series connection of the inductor 10 and capacitor 11, changes in the current flowing in the choke coil 8 are positively fed back, so that the circuit composes a resonant circuit with the capacitor 7 and inductor of the choke coil 8, thereby starting oscillation.

Figure 4:
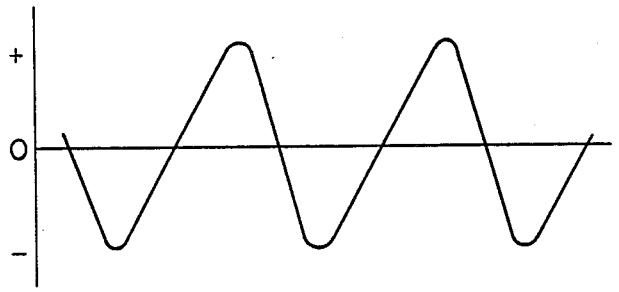
FIG. 4 is a current waveform diagram flowing in the discharge lamp when it is burned in the same embodiment.

Since the impedance of the inductor 21 of the staring circuit 17 is very low at low frequencies including DC and very high at high frequencies, the DC component of the current flowing in the discharge lamp load circuit 3 flows into the collector of the transistor 6 from the choke coil 8 by way of the filament electrode 16*a* of the fluorescent lamp 15, inductor 21 and filament electrode 16*b*. On the other hand, since the high frequency component does not flow into the inductor 21, it flows through the capacitor 22 connected in parallel to the inductor 21. By the DC component and high frequency component flowing through the starting circuit 17, the filament electrodes 16*a*, 16*b* are preheated. At the same time, between the two electrodes of the fluorescent lamp 15, a high frequency voltage is applied by the oscillation of the inverter circuit 2, so that the fluorescent lamp 15 begins to discharge. When the filament electrodes 16*a*, 16*b* are preheated to a specified temperature by the current flowing through the starting circuit 17, the fluorescent lamp 15 is ignited. When activated the voltage between the filament electrodes 16*a* and 16*b* becomes the lamp voltage of the fluorescent lamp 15. Therefore, after ignition, the high frequency current flowing in the capacitor 22 of the starting circuit 17 becomes very slight, and the capacitor 22 functions to stabilize the oscillation. On the other hand, since the impedance of the inductor 21 is very low at low frequencies including DC, the DC component of the current flowing in the discharge lamp load circuit 3 escapes through the bypass of the inductor 21, and only the high frequency component flows in the discharge path of the fluorescent lamp 15 as shown in FIG. 4.

Thus, in the first embodiment, by connecting the fluorescent lamp 15 with the high frequency inverter through choke coil 8, and connecting the inductor 21 and capacitor 22 in parallel between both filament electrode terminals of the fluorescent lamp 15, even in an inverter circuit which operates a choke coil for limiting and stabilizing the load current of the fluorescent lamp 15 as a resonant inductor, the DC component can be supplied to the collector of the transistor 6 through the filament 16 of the fluorescent lamp 15 and the inductor 21 connected to the non-feed side of the fluorescent lamp 15, so that the inverter circuit 2 may be oscillated and maintained stably. Moreover, since the number of inductors in the inverter circuit 2 can be reduced, the structure may be reduced in size and weight. At the same time, the inverter circuit 2 can be driven sufficiently and stably in the self-oscillation circuit by making use of the resonance of a simple structure including the inductor 10, capacitor 11, resistance 12, diode 13 and resistance 14 alone. During start up, this DC component can be utilized as a preheating current of the filament 16, and preheating can be accelerated. While ignited, the DC component contained in the discharge lamp current escapes through the bypass of the inductor 21 connected between both electrodes of the discharge lamp, and only the high frequency current flows in the discharge lamp, so that a discharge lamp operation apparatus free from cataphoresis phenomenon may be obtained. Furthermore, the voltage across this inductor is high in the initial stage of preheating, but since the applied time is short and it is lowered to the lamp voltage of the fluorescent lamp 15 after ignition, the inductor of a relatively small current capacity is enough, and on the whole, the discharge lamp operation apparatus of reduced size, weight and cost may be obtained.

Figure 5:
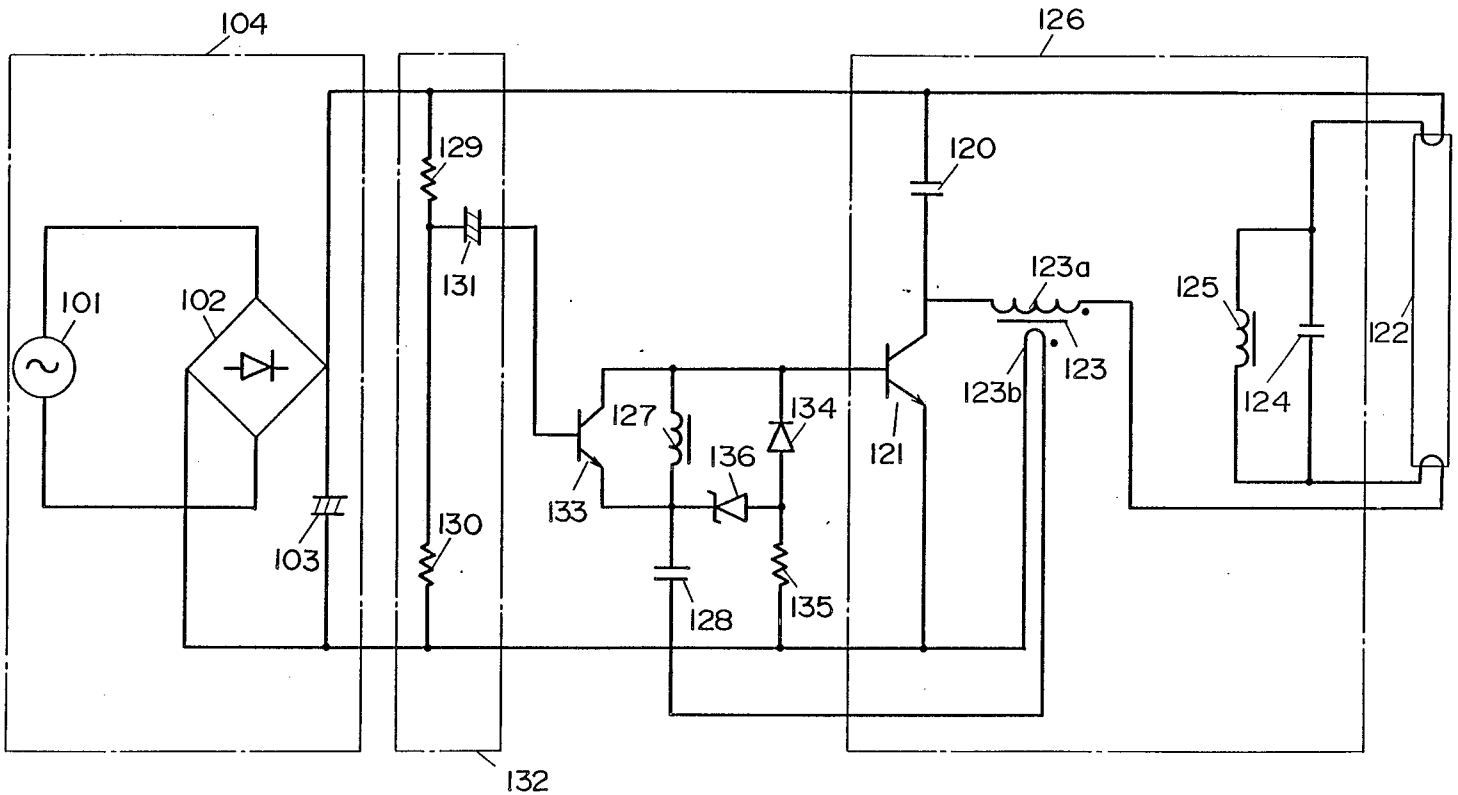
FIG. 5 is a circuit diagram in a second embodiment of the invention.

The second embodiment of the invention is described below according to the accompanying drawings. FIG. 5 is a circuit diagram showing the second embodiment of the discharge lamp operation apparatus of the invention, in which numeral 104 denotes a power supply circuit having a specific output voltage and polarity, composed of a commercial power supply 101, rectifying bridge 102, and smoothing capacitor 103. Numeral 102 denotes a capacitor connected in series to the supply 104 output, and 121 denotes and transistor connected between the capacitor 120 and power supply circuit 104. A series circuit of a fluorescent lamp 122 and inductor 123 is connected to the capacitor 120, and a capacitor 124 and an inductor 125 are connected in parallel to the non-feed supply side of the fluorescent lamp 122. Numeral 126 denotes a self-oscillated switching circuit composed of capacitor 120, transistor 121, capacitor 124, inductor 125, and inductor 123. Numeral 127 denotes a driving inductor having its one end connected to the base of the transistor 121, and between its other end and the emitter is connected a series circuit of secondary winding **123*b* of an inductor 123 and a driving capacitor 128. Numeral 132 denotes a timer circuit composed of potential dividing resistances 129, 130 connected to the output end of the power supply circuit 104, and capacitor 131 having one end connected to the connecting point of resistance 129, 103. Numeral 133 denotes a transistor having the base connected to the other end of the capacitor 131 and the collector and emitter connected to the both terminals of the inductor 127. Numeral 134 denotes a diode having the cathode connected to the base of the transistor 121 and the other end connected to the emitter of the transistor 121 through resistance 135, 136 denotes a zener diode having its anode connected to the anode of the diode 134, both being the same polarity ends, and the other end connected to the collector of the transistor 133**.

The operation of the thus composed circuit of the second embodiment of the invention is described below. When the power supply is turned on, a voltage is generated in the power supply circuit 104, and a starting current flows through the resistance 129 of the timer circuit 132, capacitor 131, and base of the transistor 133, and the transistor 133 is turned on. At the same time the transistor 121 is turned on by its base current. At the beginning, the fluorescent lamp 122 is not ignited, and the current flows from the power supply circuit 104 into the transistor 121 through the inductor 123, filament electrode of fluorescent lamp 122, capacitor 124 and inductor 125. At this time, a positive voltage is generated in the secondary winding **123*b* of the inductor 123, and the base current of the transistor 121 is supplied through the capacitor 128 and inductor 127, and the transistor 121 is maintained in the ON state. At this time, the current flowing in the primary winding 123*a* of the inductor 123 is a resonance current of the capacitor 124 and inductor 123. Here, the current flowing due to the positive voltage generated in the secondary winding 123*b* of the inductor 123 is a series resonance current at the characteristic frequency of the inductor 127 and capacitor 128, but actually since the transistor 133 is also turning on, there is a slight current flow in the reverse direction from the emitter to the collector of the transistor 133, and the state of resonance is weak. The inductor 127 can thus hardly function, and its vibration period is closer to the charging and discharging time of the capacitor 128** and is very short.

Accordingly, the capacitor 128 is charged nearly to the voltage generated in the secondary winding **123*b*, and the base current, of the transistor 121 can no longer flow. When the base current of the transistor 121 is slightly pulled in the reverse direction by the effect of the inductor 127, the transistor 121 is about to be turned on, and the voltage generated in the inductor 123*b* becomes small. The electric charge stored in the capacitor 128 is fed back to be applied in the reverse direction between the base and emitter of the transistor 121, so that the transistor 121 is turned off suddenly. When the transistor 121 is turned off, the energy stored in the series resonance circuit of capacitor 124 and inductor 123 and inductance 125 is released to the capacitor 120, fluorescent lamp 122, capacitor 124, inductor 123, and inductor 125 to oscillate, thereby becoming the preheating current of the fluorescent lamp 122. At this time, it is set so that the fluorescent lamp 122 may not be started up by the voltage generated in the capacitor 124. The oscillating current flowing in the primary winding 123*a* of the inductor 123 when the transistor 121 is turned off generates a negative voltage in the secondary winding 123*b* of the inductor 123. At this time, the transistor 133 turns on in the forward direction, and the inductor 127 does not function at all, and therefore, by this voltage a reverse voltage is applied between the base and emitter of the transistor 121 through diode 134 and resistance 134, and the transistor 121 is maintained in an OFF state. Simultaneously, the capacitor 128 is charged in the reverse direction in the forward direction characteristics of the zener diode 136 and through the resistance 135, and also through the transistor 133, diode 134 and resistance 135. When the oscillating current exceeds the negative peak, a positive voltage is gradually generated in the secondary winding 123*b* of the inductor 123, and the voltage reversely applied in the capacitor 128 during the OFF period of the transistor 121 is applied to the base of the transistor 121 in the forward direction, so that the transistor 121 is turned on. At this time, right after turning on, since the current of the inductor 123 is still flowing in the reverse direction, the collector potential of the transistor 121 is going to be lower than the emitter potential, and a reverse voltage is applied between the base and emitter of the transistor 121. However, a current is passed from the base to the collector through the diode 134 and resistance 135 so that the reverse voltage may not be applied more than the rated voltage of the transistor 121. The reverse current of the inductor 123 gradually decreases, and a forward current flows in the transistor 121, and this operation is repeated thereafter. By this oscillating operation, as time passes, the temperature of the electrodes of the fluorescent lamp 122** increases.

The timer circuit 132 supplies the base current of the transistor 133 while starting an electric charge in the capacitor 131 through the resistance 129 after the power supply is turned on, and when charged up to the voltage determined by the resistance 129, 130 after a specified time, the capacitor 131 is no longer charged, and thereafter the power supply is cut off, and no current flows in the base of the transistor 133 until the electric charge in the capacitor 131 is released through the resistances 129, 130. Accordingly, when the transistor 133 is turned off after the specified time, a positive voltage is generated in the secondary winding 123*b* of the inductance 123 when the transistor 121 is turned on, and the base current of the transistor 121 is supplied through the capacitor 128 and inductor 127. This base current is a resonance current of the capacitor 128 and inductor 127, and the base current of the transistor 121 from positive to negative near its half period. When the stored charge in the capacitance the transistor 121 is released, the transistor 121 is turned off. Before ignition of the fluorescent lamp 122, the inductor 123 and capacitor 124 are in a series resonance state, and the inductor and capacitor are set so as to generate a sufficient voltage in the capacitor 124, much larger when operating, larger than when preheating before operation of the timer circuit and sufficient to start up the fluorescent lamp 122. Therefore, the fluorescent lamp 122 is ignited. At this time, since the secondary winding voltage of the inductor 123 is high, the base circuit current of the transistor 121 also increases. Accordingly, when switching the transistor 121, and the base current is discontinuous the surge voltage applied to the inductor 127 increases, and is applied in the reverse direction between the base and emitter of the transistor 121, but the surge voltage may be suppressed by the zener voltage of the series circuit, which composed the diode 134 and zener diode 136, connected in parallel to the inductor 127. (This is the same when preheating and when operating in an ignited state.) On the other hand, when the resonance of the base circuit of the transistor 121 increases, the current peak value of the inductor 127 and the voltage peak values of the inductor 127 and capacitor 128 increase, but when the transistor 121 is turned on, if the capacitor 128 side potential of the inductor 127 is about to rise abnormally, it is suppressed by the zener voltage of the series circuit, which composed the diode 134 and zener diode 136, in parallel to the inductor 127, while it is also suppressed at the same time by the zener diode 136 and resistance 135. Furthermore, the emitter potential of the transistor 133 can be held under the specified voltage, and the voltage applied in the reverse direction between the base and emitter of the transistor 133 can be reduced. Therefore, an inexpensive transistor 133 may be used, and the reliability is improved at the same time. Moreover, since the current peak and voltage peak values of the inductor 127 can be lowered, an inductor 127 of a small rating may be used, and abnormal oscillation of the circuit due to magnetic saturation of the inductor 127 may be prevented. In addition, since the base current of the transistor 121 is prevented from becoming too large, the storage time of the transistor 121 is not extremely long, and abnormal oscillation of the circuit due to a prolonged ON time of the transistor 121 may be prevented. By contrast, when the transistor 121 is turned off, if the capacitor 128 side potential of the inductor 127 is going to descend abnormally, the capacitor 128 is charged through the zener diode 136 and resistance 135 to prevent it from becoming too low. That is, the emitter potential of the transistor 133 does not become too low, and the base potential of the transistor 133 does not become too low similarly, and the transistor 133 is prevented from being turned on, so that a malfunction may be prevented. At the same time, in the next ON cycle, the voltage applied in the reverse direction between the base and emitter of the transistor 133 is reduced, and an normal rise of the capacitor 128 side potential of the inductor 127 may be withheld, and the current peak value flowing in the zener diode 136 is kept low, and an inexpensive zener diode 136 may be used, while the same effect as during the ON time will be obtained. Furthermore, since the capacitor 128 can be charged through the zener diode 136 and resistance 135, the charging time of the capacitor 128 may be shortened, the value of the inductor 127 can be set large, the base current peak can be decreased when starting or when operating in a ignited state, and the noise is lowered and the reliability of the device is enhanced. Furthermore, acting in both ON state and OFF state, it is possible to flexibly cope with the sudden changes in the oscillation state, and it is possible to completely prevent the collector potential of the transistor 121 from becoming too large due to flow of an abnormally large current when turning on the power, when starting the discharge of the fluorescent lamp 122, or when the fluorescent lamp 122 is defective.

The operation of the circuit after starting is nearly same as that after operation of the timer circuit 132, but since the impedance of the fluorescent lamp 122 is connected in parallel to the impedance of the capacitor 124 and inductor 125, the current of the capacitor 124 decreases, and the current flows in the fluorescent lamp 122. Accordingly, resonance of the inductor 123 and capacitor 124 is almost lost, and a positive or negative voltage corresponding to the difference between the output voltage of the power supply circuit 104 and the lamp voltage is generated in the secondary winding 123*b* of the inductor 123, and the transistor 121 is turned on or off depending on the characteristic frequency due to the inductor 123, capacitor 120, fluorescent lamp 122, inductor 127 and capacitor 128, and the fluorescent lamp 122 is maintained in an ignited state. The inductor 125 is used for removing the DC component of the current of the fluorescent lamp 122.

Incidentally, when normal ignition is impossible, such as in the service end of the life of the fluorescent lamp 122, the operation state (resonance state) becomes the same as when the starting voltage is generated after operation of the timer circuit 132. When the fluorescent lamp 122 is detached, no current flows in the inductor 123, and therefore the transistor 121 is not turned on to oscillate.

Thus, in this embodiment, in a simple and inexpensive composition having a series circuit of a diode 134 and zener diode 136 connected in parallel to the inductor 127 and the resistances connected its connecting point and the emitter of the transistor 121, the emitter-base reverse voltage of the transistor 121, including the surge voltage, can be held under the rating of the transistor 121, and the voltage impressed to the inductor 127 and capacitor 128 is decreased, and the abnormal oscillation of the circuit can be prevented due to a malfunction of the transistors 121 and 133 and magnetic saturation of the inductor 127. Moreover, in this embodiment, the value of the inductor 127 can be set large, and the operation of the inductor 127 takes placed in both ON state and OFF state of the transistor 121, so that it is possible to cope with a sudden variation in the oscillation state, and it is also possible to completely prevent abnormal oscillation due to the flow of a large current when turning on the power supply, when the fluorescent lamp 122 starts to discharge, or when the lamp is abnormal, and to prevent abnormal elevation of the collector potential of the transistor so that the circuit reliability may be enhanced. Moreover, inexpensive elements may be used in the circuit such as the zener diode 136, and the circuit may be fabricated at a low cost.

Figure 6:
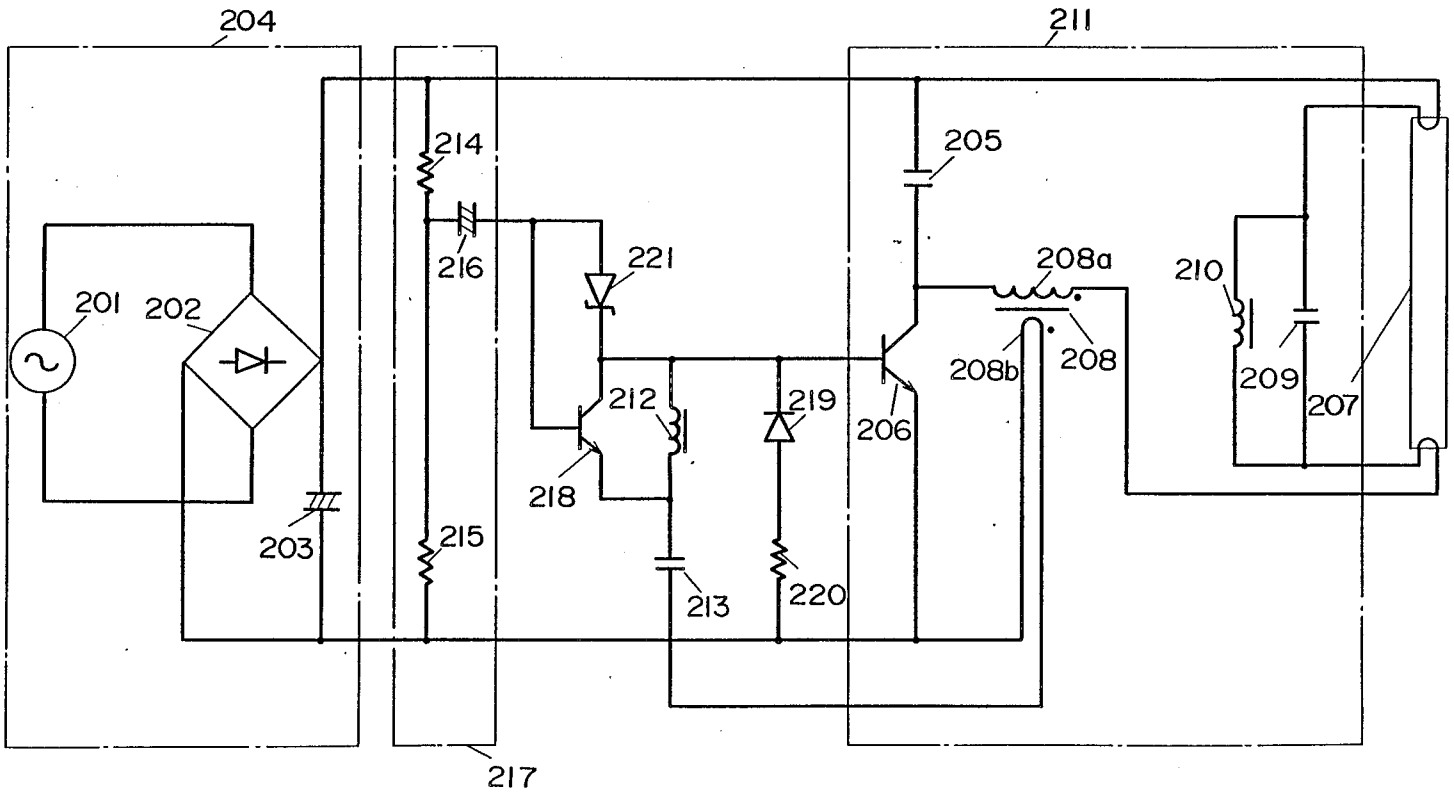
FIG. 6 is a circuit diagram in a third embodiment of the invention.

The third embodiment of the invention is described herein by reference to the appended drawings. FIG. 6 is a circuit diagram showing the third embodiment of discharge lamp operation apparatus of the invention, in which the structure and operation from the commercial power supply 201 to resistance 220 are same as in the second embodiment. What differs from the second embodiment is that a zener diode 221 is connected between the collector and base of the transistor 218 so that the base current may flow through the zener diode 221 when the collector potential of the transistor 218 is higher than the base potential.

The operation of the thus composed circuit of this embodiment is explained below. When the power supply is turned on, a voltage is generated in the power supply circuit 204, and a starting current flows through the resistance 214 of timer circuit 217, capacitor 216, and zener diode 221 in a forward direction, and the transistor 206 is turned on. Since the base-emitter voltage of the transistor 218 is suppressed under the forward voltage drop of the zener diode 221 at this time, the transistor 218 is nearly in an OFF state. Initially, the fluorescent lamp 207 is not ignited, and the current flows from the power supply circuit 204 into the transistor 206 through the inductor 208, filament electrodes of fluorescent lamp 207, capacitor 209 and inductor 210. At this time, a positive voltage is generated in the secondary winding **208*b* of the inductor 208, and the base current of the transistor 206 is supplied through the capacitor 213 and inductor 212, and the ON state of the transistor 206 is maintained. At this time, the current flowing in the primary winding 208*a* of the inductor 208 is a resonance current of the capacitor 209 and inductor 208. Since the base-collector voltage of the transistor 218 is held below the forward voltage drop of the zener diode 221, the transistor 218 is nearly in an OFF state. Accordingly, the current flowing due to the positive voltage generated in the secondary winding 208*b* of the inductor 208 securely passes through the inductor 212, thereby becoming the initial transient current of the series resonance circuit at the characteristic frequency of the inductor 212 and capacitor 213. Therefore, due to the effect of the inductor 212, the capacitor 213 is charged up to a voltage higher than the voltage generated in the secondary winding 208*b*, the base current of the transistor 206 no longer flows 206 is pulled in the reverse direction. Accordingly, the transistor 206 is about to be turned off, and the voltage generated in the inductor 208*b* decreases. The electric charge stored in the capacitor 213 is negatively fed back to be applied in the reverse direction between the base and emitter of the transistor 206, so that the transistor 206 is suddenly turned off. When the transistor 206 is turned off, the energy stored in the series resonance circuit of the capacitor 209 and inductor 208 and the inductor 225 flows into the capacitor 205, fluorescent lamp 207, capacitor 209, inductor 208 and inductor 210 to oscillate, thereby becoming the preheating current for the fluorescent lamp 207. Thus, the circuit can be started up securely. Moreover, the oscillating current flowing in the primary winding 208*a* of the inductor 208 when the transistor 206 is turned off generates a negative voltage at the secondary winding 208*b* of the inductor 208. At this time, the transistor 218 turns ON in the forward direction, and the inductor 212 does not function at all, and a reverse voltage is applied between the base and emitter of the transistor 206 through diode 219 and resistance 220 by this voltage, and the OFF state of the transistor 206 is maintained. At the same time, the capacitor 213 is largely charged in the reverse direction through the transistor 218. When the oscillating current exceeds the negative peak, the negative voltage of the secondary windings 208*b* of the inductor 208 gradually decreases, and the voltage charged in the reverse direction in the capacitor 213 while the transistor 206 is turned off is applied in the forward direction to the base of the transistor 206 through the inductor 212, so that the transistor 206 is turned on. Right after turning on, however, since the current of the inductor 208 is still flowing in the reverse direction, the current flows from the base to the collector through the diode 219 and resistance 220. The reverse current of the inductor 208 decreases gradually and a forward current flows in the transistor 206, and thereafter the same operation is repeated. In this case, when the negative voltage decreases in the secondary winding 208*b*, the capacitor 213 is charged nearly up to the voltage generated in the secondary winding 208*b* in the reverse direction, the transistor 206 is turned on immediately, the turn-on timing is accelerated, and the OFF period of the transistor 206 becomes short. Furthermore, of the ON time of the transistor 206 due to resonance of the inductor 212 and capacitor 213, the period of flowing in the forward direction from the collector to the base becomes short, and finally the energy stored in the inductor 208 when the transistor 206 is turned off decreases, and a small resonance state is maintained. Incidentally, at this time, it is so set that the fluorescent lamp may not be started by the voltage generated at the capacitor 209**.

In this oscillation operation, the temperature of the preheating electrode of the fluorescent lamp 207 is raised as time elapses.

The timer circuit 217, meanwhile, supplies the base current of the transistor 218 while storing a charge in the capacitor 216 through the resistance 214 after the power supply is turned on, and when charged up to the voltage determined by the resistances 214, 214 after a specified time, the capacitor 216 is no longer charged, and the power supply is turn off, and no current flows in the base of the transistor 218 until the charge in the capacitor 216 is discharged through the resistances 214, 215. Accordingly, when the transistor 218 is turned off after the specified time, a positive voltage is generated in the secondary winding **208*b* of the inductor 208 as the transistor 206 is turned on, and the base current of the transistor 206 is supplied through the capacitor 213 and inductor 212. This base current is a resonance circuit of the capacitor 213 and inductor 212, and the base current of the transistor 206 changes from positive to negative near half period. When the stored charge in the transistor 206 is discharged, the transistor 206 is turned off. Before the start of the fluorescent lamp 207, the inductor 208 and capacitor 209 are in a series resonance state, and the inductor and capacitor are set so as to generate, in the capacitor 209, a sufficient voltage being much larger than when burning operating in an ignited state, larger than when preheating before operation of timer circuit, and sufficient to start the fluorescent lamp 207. As a result, the fluorescent lamp 207 is ignited. At this time, since the secondary winding voltage of the inductor 208 increases, the base current of the transistor 206 also increases. Therefore, when the base current is discontinuous upon switching of the transistor 206, the surge voltage generated at the inductor 212 increases, and is applied in the forward direction between the base and emitter of the transistor 206. However, this surge voltage is suppressed by the zener voltage of the circuit, which comprised the transistor 218 and zener diode 221, connected in parallel to the inductor 212. (This is the same when preheating and when operating in an ignited state.) Moreover, when the resonance of the base circuit of the transistor 206 increases, the current peak value of the inductor 212 and the voltage peak values of inductor 212 and capacitor 213 are going to increase. However, when the transistor 206 is turned off, if the capacitor 213 side potential of the inductor 212 is going to become abnormally large, it is inhibited as the transistor 218 is turned on at the zener voltage due to the transistor 218 and zener diode 221 in parallel to the inductor 212, and the capacitor 213 is immediately charged, skipping the inductor 212, and the phase of the resonance current is shifted, and the turn-on timing of the transistor 206 is accelerated. Accordingly, by suppressing the resonance of the inductor 208 and capacitors 205, 209, the current peak and voltage peak values of the inductor 212 can be kept low, and an inductor 212 of a small rating may be used, while the abnormal oscillation of the circuit due to magnetic saturation of the inductor 212 may be prevented. Moreover, since the base current of the transistor 206 is prevented from becoming too large, the storage time of the transistor 206 does not become extremely long, and the abnormal oscillation of the circuit due to a prolonged ON time of the transistor 206 may be prevented. In this case, furthermore, the emitter potential of the transistor 218 can be held under a specified voltage, and the voltage applied in the reverse direction between the base and emitter of the transistor 218 may be reduced. Accordingly, an inexpensive transistor 218 be used, while the reliability is enhanced. Moreover, when the transistor 206 is turned on, if the capacitor 213 side potential of the inductor 212 elevates, since the zener diode 221 is inserted in the forward direction between the collector and emitter of the transistor 218, the stored charge in the transistor 218** can be promptly discharged to the collector to be prevented from turning on, so that the circuit will not malfunction.

After starting, the operation of the circuit is nearly the same as that after operation of the timer circuit 217, except that the current of the capacitor 209 decreases to cause the current, to flow in the fluorescent lamp 207 since the impedance of the fluorescent lamp 207 is connected in parallel to the impedance of the capacitor 209 and inductor 210. Accordingly, the resonance of the inductor 208 and capacitor 209 is almost lost, and a positive or negative voltage according to the difference between the output voltage of the power supply circuit 204 and the lamp voltage is generated in the secondary winding **208*b* of the inductor 208, and the transistor 206 is turned on or off depending on the characteristic frequency due to the inductor 208, capacitor 205, fluorescent lamp 207, inductor 212 and capacitor 213, and the fluorescent lamp 207 is maintained in an ignited state. In this embodiment, since the output voltage of the power supply circuit 204 is obtained by rectifying and smoothing the commercial power supply 201, it contains slight ripples, and ripples are supplied through the resistance 214 of the timer circuit 217 and the capacitor 216 as the base current of the transistor 218, which led to malfunctions of the transistor 218 in the prior art. However, in this embodiment, since the current passes through the zener diode 221, the transistor 218 will not malfunction. Therefore, it does not matter if output ripples are contained in the power supply circuit 204 and timer circuit 217**.

When normal ignition is not possible, such as a the end of the life of the fluorescent lamp 207, the circuit, operation state (resonance state) becomes the same as when the starting voltage is generated after operation of the timer circuit 217. When the fluorescent lamp 207 detached, since no current flows in the inductor 208, the transistor 206 is not turned on to oscillate.

Thus, according to this embodiment, in a simple and inexpensive structure having a circuit, which is composed a the transistor 218 and zener diode 221, connected in parallel to the inductor 212, the voltage applied to the inductor 212 and capacitor 213 can be reduced, and malfunction of the transistors 206 and 218 and abnormal oscillation of the circuit due to magnetic saturation of the inductor 212 can be prevented. Moreover, the circuit can be started up securely. Also in this embodiment, since the output ripples of the timer circuit due to power supply ripples can be absorbed, it does not matter if the power supply circuit 204 and timer circuit 217 contain output ripples, and the structure may be simplified and lowered in cost, while stable starting and ignited may be realized.

Figure 7:
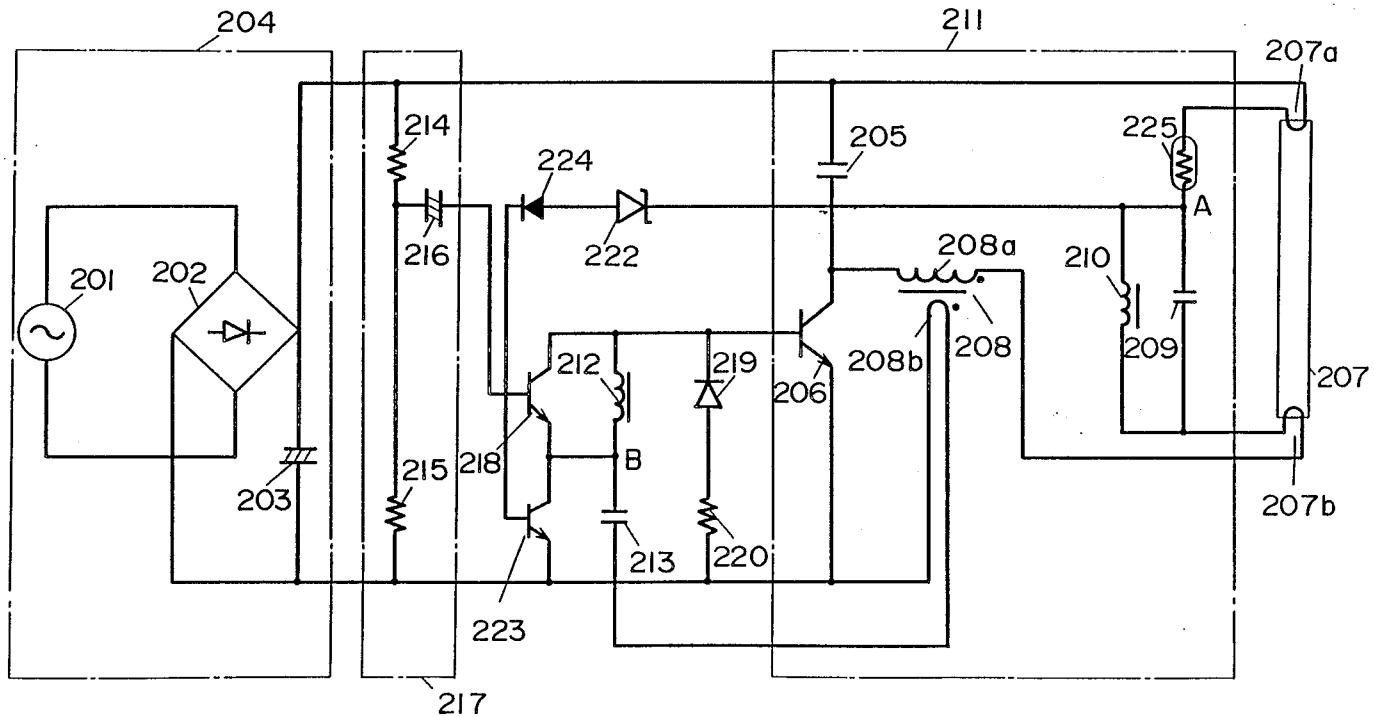

Referring then to FIG. 7, the fourth embodiment of the invention is described below. In FIG. 7, the structure and operation from the commercial power supply 201 to resistance 220 are same as in the second embodiment. The distinctions between the second and fourth embodiments are as follows: a PTC thermistor 225 is connected in series between the anti-transistor side electrode and the capacitor 209 which is the starting circuit, at the non-feeding side of the fluorescent lamp 207 which is the discharge lamp, a zener diode 222 which is a voltage response switch element is connected at one side at the connecting point A of the PTC thermistor 225 and capacitor 209, and a transistor 223 which is a three-terminal control device is connected at the other end of the zener diode 222, for stopping the current for driving the transistor 206 from the driving circuit of the switching circuit 221 by the current flowing into the base connected through the diode 224. Moreover, in the fourth embodiment, the driving circuit is composed of the inductors 208, 212 and the capacitor 213.

Figure 8:
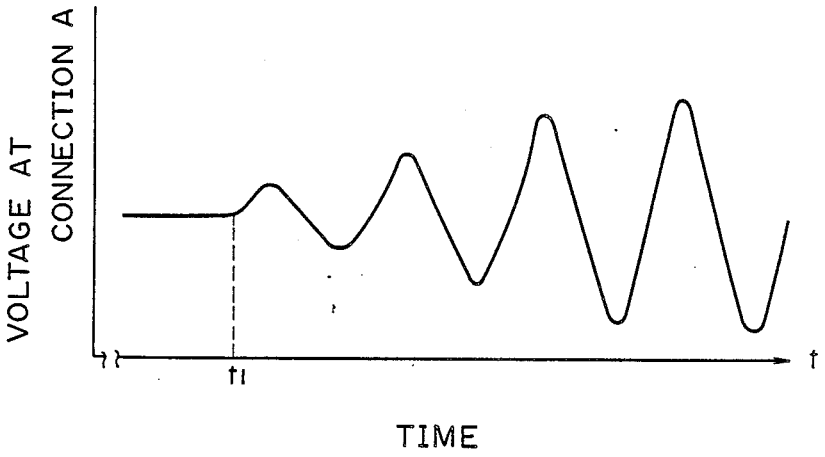
FIG. 8 is a diagram showing the changes in the voltage at connecting point A between PTC thermistor and capacitor when the resistance of the PTC thermistor varies.

The operation of the thus composed circuit is explained below. The operation from turning on the power supply until normal ignition of the fluorescent lamp 207 is same as in the second embodiment, and its, explanation is omitted herein, and those operations which differ from the second embodiment are described below. When the electrode **207*a* of the fluorescent lamp 207 is emitterless while there is an emitter at the electrode 207*b*, by turning on the power supply 201, the switching circuit 211 begins to oscillate as in the second embodiment. However, since the electrode 207*a* of the fluorescent lamp 207 is emitterless, the lamp current flows from the electrode 207*a* into the electrode 207*b*, but does not does so in the reverse direction. Accordingly, a large current corresponding to the lamp current flows in the PTC thermistor 225 through the capacitor 209, and the temperature of the PTC thermistor 225 goes up, and when elevating nearly to the curie temperature, the resistance of the PTC increases suddenly. The changes in the voltage at connecting point A between the PTC thermistor 225 and the capacitor 209 when the resistance of the PTC thermistor 225 varies are shown in FIG. 8. Before, $t_1$ the resistance of the PTC thermistor 225 is low, and the voltage at connecting point A is not so different from the potential difference from the positive voltage side of the power supply circuit 204** and is close to the output voltage of the power supply circuit 204. After $t_1$, the resistance of the PTC thermistor 225 is increased, and as the resistance becomes larger, the resonance voltage of the capacitor 209 and inductor 208 overlays to increase the peak voltage. When the peak voltage at the connecting point A reaches the operating voltage of the zener diode 222, a current flows into the base of the transistor 223 through the zener diode 222 and diode 224 from the connecting point A, and the transistor 223 is turned on, thereby short-circuiting between the connecting point B of the capacitor 213 and inductor 212 and the negative voltage side of the power supply 204. As a result, the supply of base current into the transistor 206 is stopped, and the operation of the switching circuit 211 is stopped.

The operation is as follows when the electrode **207*b* of the fluorescent lamp 207 is emitterless and the electrode 207*a* has an emitter, and when both electrodes 207*a* and 207*b* are emitterless. In these cases, since there is almost no current flowing from the power supply circuit 204 directly from the fluorescent lamp 207, the current directly passes from the power supply circuit 204 into the PTC thermistor 225, and the resistance of the PTC thermistor 225 is suddenly increased, the oscillation operation of the switching circuit 211 is stopped by the transistor 223, there is almost no current flowing from the power supply circuit 204 through the fluorescent lamp 207 and capacitor 209, and there is no base current of the transistor 206 flowing through the inductor 208, so that the oscillation action of the switching circuit 211** is securely stopped.

In this embodiment, meanwhile, since the timer circuit 217 is provided, when the oscillation operation of the switching circuit 211 is once stopped, the oscillation operation of the switching circuit 211 is not resumed unless the power supply circuit 204 is turned off and turned on again.

In these first to fourth embodiments, the fluorescent lamps were used as the discharge lamps, but other preheat starting type lamps may be sued. Moreover, in the high pressure discharge lamp which does not require preheating, similar effects other than preheating will be obtained. The benefits of the invention are not different if the inverter circuit and switching circuit are of one-switching device type, two-switching device type, four-switching device type or the like. At the power supplies for driving, the secondary windings 9, **123*b*, 208*b* of inductors 8, 123, 208 were used, but the same effect will be obtained when composed to supply from other inductors. The power supply circuit may be similarly replaced by a storage battery, switching regulator, and other. As the transistors, FETs and others may be used. In the second, third and fourth embodiments, the timer circuits 132, 217 may be also replaced by others. In the fourth embodiment, the voltage response switching element may be replaced by a varistor, diac or others which are capable of passing a necessary electric current when exceeding a specific voltage. As the transistor 223 for stopping the driving circuit, FET, thyristor or others may be used. The position for installing the transistor 223 for stopping the driving circuit may be somewhere between the base and emitter of the transistor 206** or an other place. The timer circuit for preheating may be omitted. In the first and fourth embodiments, the self-oscillation switching circuit may be similarly replaced by separately oscillated type or other type. In the second and third embodiments, the locations of the inductor and capacitor for driving may be exchanged, but the effects are greater in the configuration shown in the illustrated embodiments.

While specific embodiments of the invention have been illustrated and described herein, it is realized that other modifications and changes will occur to those skilled in the art. It is therefore to be understood that the appended claims are intended to cover all modifications and changes as fall within the true spirit and scope of the invention.

We claim:

1. A discharge lamp apparatus for controlling activation of a discharge lamp, the discharge lamp having first and second electrodes, each of the first and second electrodes having first and second terminals, said apparatus comprising:

power supply means for outputting a supply voltage of a constant polarity;

switching means, coupled to said power supply means and having means for coupling to the first terminals of the first and second electrodes of the discharge lamp, for supplying a high frequency signal to the discharge lamp for igniting the discharge lamp; and, a starting circuit having a first and second means for respectively connecting to the second terminals of the first and second electrodes of the discharge lamp, and having a first inductor and a first capacitor connected to each other in parallel and coupled to said first and second connecting means.

2. An apparatus as recited in claim 1, said switching means comprising a second inductor having means for connecting in series to the discharge lamp, said second inductor operating to cause resonance of said switching means.

3. An apparatus as recited in claim 1, said switching means comprising:

a transistor device having a base coupled to a first output terminal of said power supply means and an emitter coupled to a second output terminal of said power supply means;

a second inductor, having a secondary winding, coupled to said first terminal of said power supply means and having means for coupling to the first terminal of the first electrode of the discharge lamp;

first and second series circuits coupled between said base of said transistor device and an emitter of said transistor device;

said first series circuit comprising a first resistive device and a diode, wherein a cathode of said diode is coupled towards said base of said transistor;

said second series circuit comprising said secondary winding, a second capacitor and a third inductor, said second capacitor and said third inductor controlling activation of said transistor.

4. An apparatus as recited in claim 3, said switching means further comprising a third capacitor coupled between said first output terminal of said power supply means and a collector of said transistor device, and a second resistive device coupled between said first output terminal of said power supply mans and said base of said transistor device, and means for coupling said collector of said transistor to the first terminal of the second electrode of the discharge lamp.

5. A discharge lamp apparatus for controlling activation of a discharge lamp, the discharge lamp having first and second electrodes, each of the first and second electrodes having first and second terminals, said apparatus comprising:

power supply means for outputting a supply voltage of a constant polarity;

switching means, coupled to said power supply means and having means for coupling to the first terminals of the first and second electrodes of the discharge lamp, for supplying a high frequency signal to the discharge lamp for igniting the discharge lamp; and, a starting circuit having a first and second means for respectively connecting to the second terminals of the first and second electrodes of the discharge lamp, and having a first inductor and a first capacitor connected to each other tin parallel and coupled to said first and second connecting means;

said switching means comprising (a) a transistor device having a base coupled to a first output terminal of said power supply means and an emitter coupled to a second output terminal of said power supply means, (b) a second inductor, having a secondary winding, coupled to said first terminal of said power supply means and having means for coupling to the first terminal of the first electrode of the discharge lamp, (c) first and second series circuits coupled between said base of said transistor device and an emitter of said transistor device, said first series circuit comprising a first resistive device and a diode, wherein a cathode of said diode is coupled to said base of said transistor, said second series circuit comprising said secondary winding a second capacitor and a third inductor, said second capacitor and said third inductor controlling activation of said transistor, and (d) a zener diode having an anode coupled to an anode of said diode of said first series circuit and a cathode coupled to a connecting point of said second capacitor and said third inductor of said second series circuit.

6. An apparatus as recited in claim 5, said switching means further comprising (e) a third capacitor coupled between said first output terminal of said power supply means and a collector of said transistor device, (f) a second resistive device coupled between said first output terminal of said power supply means and said base of said transistor device, and (g) means for coupling said collector of said transistor to the first terminal of the second electrode of the discharge lamp.

7. A discharge lamp apparatus for controlling activation of a discharge lamp, the discharge lamp having first and second electrodes, each of the first and second electrodes having first and second terminals, said apparatus comprising:

power supply means for outputting a supply voltage of a constant polarity;

switching means, coupled to said power supply means and having means for coupling to the first terminals of the first and second electrodes of the discharge lamp, for supplying a high frequency signal to the discharge lamp for igniting the discharge lamp; and, a starting circuit having a first and second means for respectively connecting to the second terminals of the first and second electrodes of the discharge lamp, and having a first inductor and a first capacitor connected to each other in parallel and coupled to said first and second connecting means;

said switching means comprising (a) a transistor device having a base coupled to a first output terminal of said power supply means and an emitter coupled to a second output terminal of said power supply means, (b) a second inductor, having a secondary winding, coupled to a collector of said first transistor device and having means for coupling to the second terminal of the first electrode of the discharge lamp, (c) first and second series circuits coupled between said base of said first transistor device and an emitter of said transistor device, said first series circuit comprising a first resistive device and a diode, wherein a cathode of said diode is coupled to said base of said first transistor device, said second series circuit comprising said secondary winding, a second capacitor and a third inductor, said third inductor being coupled to said base of said first transistor device, (d) a second transistor device having an emitter and a collector coupled across said third inductor, (e) a zener diode coupled between said collector and a base of said second transistor device, and (f) a timing means, coupled to said base of said second transistor device and said power supply means, for turning off said second transistor device upon a predetermined period of time.

8. An apparatus as recited in claim 7, said switching means further comprising a third capacitor coupled between a first output terminal of said power supply means and said collector of said first transistor device, and means for coupling said first output terminal of said power supply means to the first terminal of the first electrode of the discharge lamp.

9. A discharge lamp apparatus for controlling activation of a discharge lamp, the discharge lamp having first and second electrodes, each of the first and second electrodes having first and second terminals, said apparatus comprising:

power supply means for outputting a supply voltage of a constant polarity;

switching means, coupled to said power supply means and having means for coupling to the first terminals of the first and second electrodes of the discharge lamp, for supplying a high frequency signal to the discharge lamp for igniting the discharge lamp; and, a starting circuit comprising a series connection of a PTC thermister and a parallel coupled capacitor and inductor, and means for coupling said series connection to the second terminals of the first and second electrodes of the discharge lamp;

a voltage response switch element coupled at one end to a coupling point of said PTC thermister and said capacitor; and control means, coupled to another end of said voltage response switch element and to said switching means, for controlling activation of said switching means according to said voltage response switch element.

10. A discharge lamp apparatus for controlling activation of a discharge lamp, the discharge lamp having first and second electrodes, each of the first and second electrodes having first and second terminals, said apparatus comprising:

power supply means for outputting a supply voltage of a constant polarity;

switching means, coupled to said power supply means and having means for coupling to the first terminals of the first and second electrodes of the discharge lamp, for supplying a high frequency signal to the discharge lamp for igniting the discharge lamp; and, a starting circuit comprising a parallel connection of an inductor and a series coupled capacitor and PTC thermister, and means for coupling said parallel connection to the second terminals of the first and second electrodes of the discharge lamp;

a voltage response switch element coupled at one end to a coupling point of said PTC thermister and said capacitor; and control means, coupled to another end of said voltage response switch element and to said switching means, for controlling activation of said switching means according to said voltage response switch element.

* * * * *